US006588025B1

(12) United States Patent
Helmolt

(10) Patent No.: US 6,588,025 B1
(45) Date of Patent: Jul. 8, 2003

(54) TOILET EXHAUST DEVICE, KIT AND METHOD OF USING

(76) Inventor: Wendell R. Helmolt, 3712 Doral St, Palm Harbor, FL (US) 34685

( * ) Notice: Subject to any disclaimer, the term of this patent is extended or adjusted under 35 U.S.C. 154(b) by 0 days.

(21) Appl. No.: 10/295,236

(22) Filed: Nov. 15, 2002

(51) Int. Cl.[7] ..... E03D 9/04
(52) U.S. Cl. ..... 4/213
(58) Field of Search ..... 4/213, 217, 209 R

(56) References Cited

U.S. PATENT DOCUMENTS 4,175,293 A * 11/1979 Stephens et al. ..... 4/209 R
4,876,748 A * 10/1989 Chun ..... 4/213
5,671,484 A * 9/1997 Lee, III ..... 4/213
6,016,576 A * 1/2000 Happe ..... 4/213
6,260,214 B1 * 7/2001 Smith ..... 4/213
6,360,377 B2 * 3/2002 Sollami ..... 4/213

* cited by examiner

*Primary Examiner*—Gregory Huson
*Assistant Examiner*—Huyen Le

(57) ABSTRACT

A new and improved device, kit and associated method of using is disclosed for placement onto a standard commode having a movable toilet seat pivotally hinged to a bowl of the commode and for venting noxious odors emanating from the bowl. The device comprises a base, a vent chamber, a collection tube, a housing and a vent tube. The base and the vent chamber are positioned near the rear top portion of the bowl in which when the toilet seat is in a horizontally lowered position, then an on/off switch is enabled which activates the fan within the housing to suck any noxious odors from the vicinity of the bowl through the vent tube via the vent chamber, collection tube and housing. The kit comprises the unassembled components of the device. The method of using comprises the steps of adhering, adjoining, affixing, coupling, defecating, drilling, dropping, flushing, inserting, leaving, lifting, obtaining, plugging, pressing, sitting, standing, and sticking.

20 Claims, 3 Drawing Sheets

FIG. 2
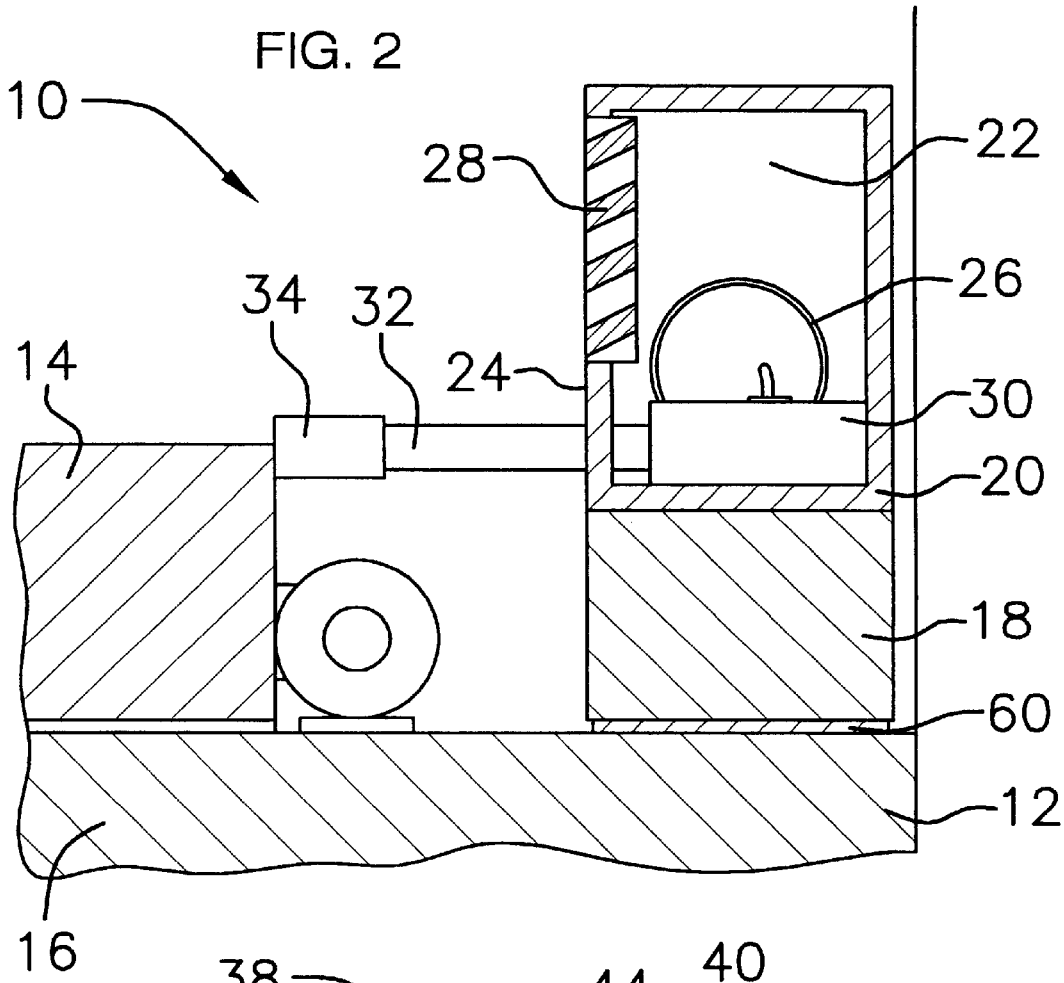
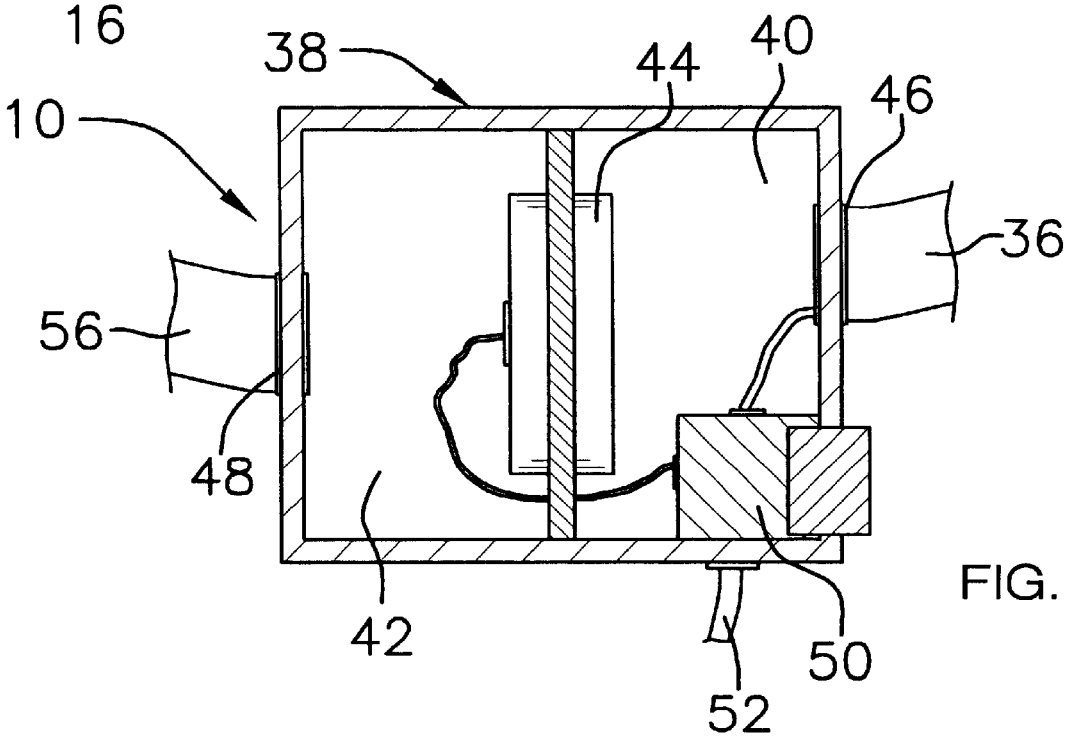
FIG. 3

TOILET EXHAUST DEVICE, KIT AND METHOD OF USING

FIELD OF THE INVENTION

The present invention relates to air freshening devices, more particularly, to a toilet ventilation device for automatically venting noxious odors from the vicinity of a commode.

DESCRIPTION OF THE PRIOR ART

In every person's daily life the restroom or bathroom is undoubtedly one of the most frequently visited places, due to the fact that everyone must unavoidably use the restroom several times in a day. Although the restroom is an important place in a person's daily life, it is scarcely emphasized. In addition, since the restroom involves the privacy of an individual, no one speaks of restrooms in social situations. As a result, the advancement of restroom technology has not kept up with other advancements in civilization, even being reduced to a sub-culture.

In the evolving history of the restroom, certainly the present day toilet design is an advanced one. The toilet can collect a man's excrement and discharge it into the outdoor disposing pool so that the indoor cleanliness can be maintained in order to meet the requisite requirements of a person's quality of life. Except for cosmetic changes, however, there has been little improvement in the function of a toilet. The most disliked aspect of today's toilet is that the unpleasant odor when using the toilet cannot be effectively expelled from the toilet. Since the restroom is a small closed space associated with an individual's privacy, air therein cannot be well circulated to overcome the problem of a stagnant and often times hideously unpleasant smell. The conventional way to reduce the pollution of unpleasant smell, or odor, is for the restroom to have ceiling fans provided on the roof to discharge the unpleasant smell to the outdoors. Unfortunately, the deodorizing effect brought about by ceiling fans is often times quite inadequate and thus limited.

A wide variety of toilet ventilation systems is currently available on the commercial market and an even larger number of these types of devices are known in the art of toilet ventilation systems, for example, the automatic toilet installation disclosed by Bondonio in U.S. Pat. No. 3,735,429; the toilet assembly having an automatic ventilation system disclosed by Sim in U.S. Pat. No. 5,715,543; the toilet air freshener disclosed by Horan and Horan in U.S. Pat. No. 5,896,591; the toilet ventillation system disclosed by Norton in U.S. Pat. No. 6,052,837; the deodorizing toilet seat pad disclosed by Lo in U.S. Pat. No. 6,163,893; and the combined ventilated toilet seat and toilet seat cover disclosed by Arroyo in U.S. Pat. No. D336,331.

While all of the above-described devices fulfill their respective, particular objectives and requirements, the aforementioned patents do not describe a toilet exhaust device having a base; a vent chamber; a collection tube; a housing; and a vent tube. This combination of elements would specifically match the user's particular individual needs of making it possible to automatically enable an on/off switch to activate the fan within the housing to suck any noxious odors from the vicinity of the bowl through the vent tube via the vent chamber, collection tube and housing when the toilet seat is lowered into a horizontal position. The above-described patents make no provision for a toilet exhaust device having a base; a vent chamber; a collection tube; a housing; and a vent tube.

Therefore, a need exists for a new and improved toilet exhaust device having a base; a vent chamber; a collection tube; a housing; and a vent tube. In this respect, the toilet exhaust device according to the present invention substantially departs from the conventional concepts and designs of the prior art, and in doing so provides an apparatus primarily developed for the purpose of automatically enabling an on/off switch to activate the fan within the housing to suck any noxious odors from the vicinity of the bowl through the vent tube via the vent chamber, collection tube and housing when the toilet seat is lowered into a horizontal position.

SUMMARY OF THE INVENTION

The present device, kit and associated method according to the principles of the present invention, overcomes the shortcomings of the prior art by providing a new and improved device, kit and associated method of using for placement onto a standard commode having a movable toilet seat pivotally hinged to a bowl of the commode and for venting noxious odors emanating from the bowl. The device comprises a base; a vent chamber; a collection tube; a housing; and a vent tube. The base and the vent chamber are positioned near the rear top portion of the bowl in which when the toilet seat is in a horizontally lowered position, then an on/off switch is enabled which activates the fan within the housing to suck any noxious odors from the vicinity of the bowl through the vent tube via the vent chamber, collection tube and housing. The kit comprises the unassembled components of the device. The method of using comprise s the steps of adhering, adjoining, affixing, coupling, defecating, drilling, dropping, flushing, inserting, leaving, lifting, obtaining, plugging, pressing, sitting, standing, and sticking.

In view of the foregoing disadvantages inherent in the known type toilet ventilation device now present in the prior art, the present invention provides an improved toilet exhaust device, which will be described subsequently in great detail, is to provide a new and improved toilet exhaust device which is not anticipated, rendered obvious, suggested, or even implied by the prior art, either alone or in any combination thereof.

To attain this, the present invention essentially comprises a base; a vent chamber; a collection tube; a housing; and a vent tube. The base and the vent chamber are positioned near the rear top portion of the bowl in which when the toilet seat is in a horizontally lowered position, then an on/off switch is enabled which activates the fan within the housing to suck any noxious odors from the vicinity of the bowl through the vent tube via the vent chamber, collection tube and housing.

There has thus been outlined, rather broadly, the more important features of the invention in order that the detailed description thereof that follows may be better understood, and in order that the present contribution of the art may be better appreciated.

The invention may also include a plurality of pressure switches. There are of course, additional features of the invention that will be described hereinafter and which will form the subject matter of the claims attached.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved toilet exhaust device that has all the advantages of the prior art toilet exhaust device and none of the disadvantages.

It is another object of the present invention to provide a new and improved toilet exhaust device that may be easily and efficiently manufactured and marketed.

An even further object of the present invention is to provide a new and improved toilet exhaust device that has a low cost of manufacture with regard to both materials and labor, and which accordingly is then susceptible of low prices of sale to the consuming public, thereby making such multipurpose storage unit and system economically available to the buying public.

Still another object of the present invention is to provide a new toilet exhaust device that provides in the apparatuses and methods of the prior art some of the advantages thererof, while simultaneously overcoming some of the disadvantages normally associated therewith.

Even still another object of the present invention is to provide a toilet exhaust device having a base; a vent chamber; a collection tube; a housing; and a vent tube. This combination of elements makes it possible to automatically enable an on/off switch is to activate the fan within the housing to suck any noxious odors from the vicinity of the bowl through the vent tube via the vent chamber, collection tube and housing when the toilet seat is lowered into a horizontal position.

Another object of the present invention is to provide a new and improved kit comprising the unassembled components of the device.

Lastly, it is an object of the present invention to provide a new and improved method of using comprises the steps of adhering, adjoining, affixing, coupling, defecating, drilling, dropping, flushing, inserting, leaving, lifting, obtaining, plugging, pressing, sitting, standing, and sticking.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompany drawings and description matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a partial cross sectional side view of a preferred embodiment of the toilet exhaust device of the present invention;

FIG. 3 is a cross sectional view of the housing of a preferred embodiment of the toilet exhaust device of the present invention.

The same reference numerals refer to the same parts throughout the various figures.

DETAILED DESCRIPTION OF THE PREFERRED EMBODIMENT

Figure 1:
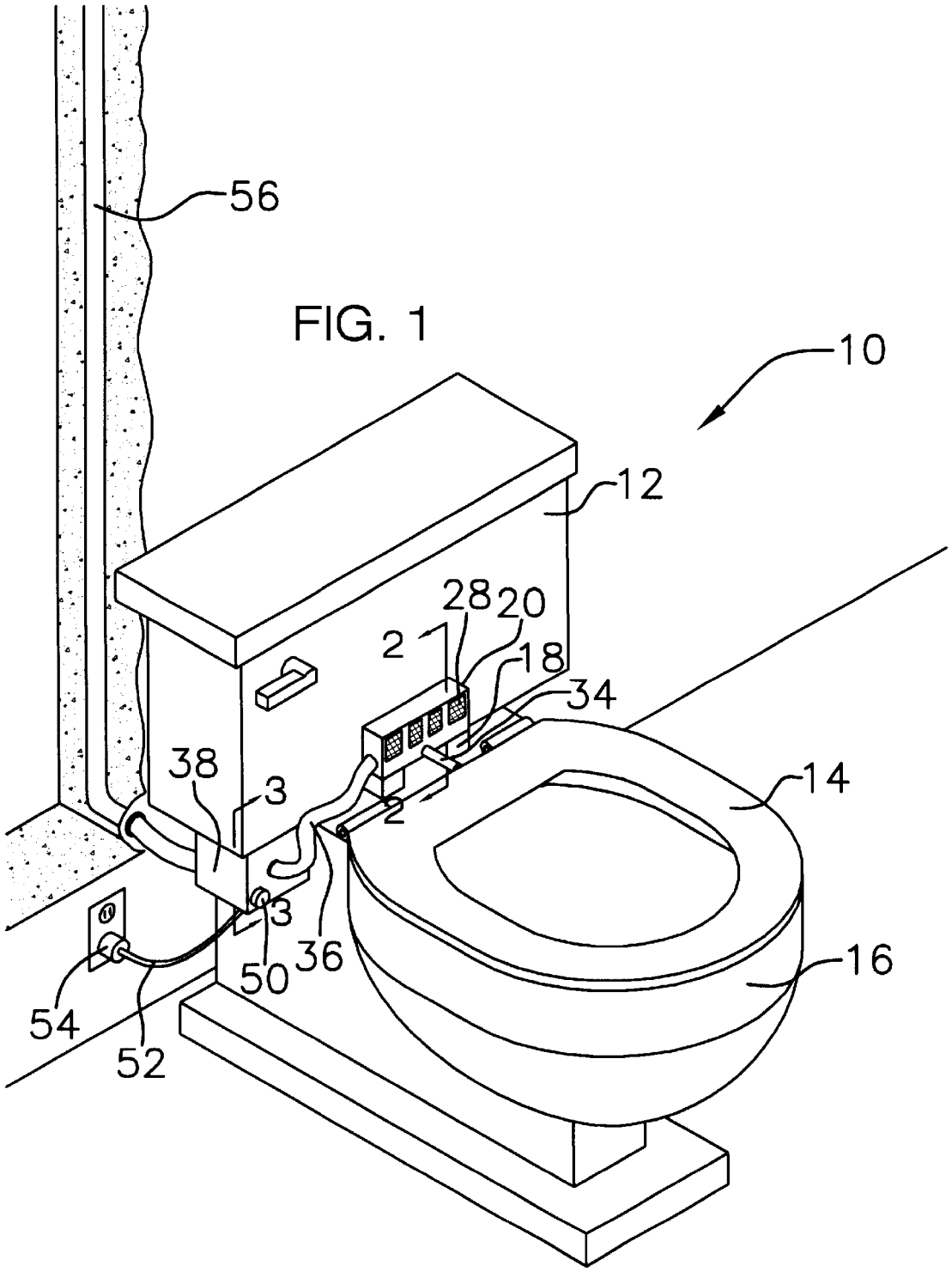
FIG. 1 is a perspective view of a preferred embodiment of the toilet exhaust device constructed in accordance with the principles of the present invention.

Referring now to the drawings, and in particular FIGS. 1 to 4 thereof, one preferred embodiment of the present invention is shown and generally designated by the reference numeral 10. One preferred embodiment of a toilet exhaust device 10 for placement onto a standard commode 12 having a movable toilet seat 14 pivotally hinged to a bowl 16 of the commode 12, the device 10 comprising: a base 18; a vent chamber 20; a collection tube 36; a housing 38; and a vent tube 56. The base 18 is mounted onto a top rear portion of the bowl 16 of the commode 12. The vent chamber 20 is attached on top of the base 18 of the device 10, in which the vent chamber 20 includes: a centrally disposed hollow core 22; an input vent collar 24; an output vent collar 26; a filter 28; an on/off switch 30; a spring 32; and a plunger 34. The input vent collar 24 defining an input vent hole. The output vent collar 26 defining an output vent hole. The filter 28 is attached around the input vent collar 24, in which the filter 28 is in fluid communications between the air outside of the vent chamber 20 and in fluid communications with the centrally disposed hollow core 22 of the vent chamber 20. The on/off switch 30 is attached to the vent chamber 20. The spring 32 is attached to the on/off switch 30. The plunger 34 is attached to both the on/off switch 30 and attached to the spring 32. The plunger 34 is slidably connected to a back portion of the movable toilet seat 14, wherein when the movable toilet seat 14 is pivotally moved upwardly to a horizontal lowered position then the plunger 34 pushes into the on/off switch 30 whereby placing the on/off switch 30 in an enabled mode, when the movable toilet seat 14 is pivotally moved into a vertical upright position then the spring 32 pushes the plunger 34 away from the on/off switch 30 whereby retracting the plunger 34 from the on/off switch 30 thereby placing the on/off switch 30 in an unenabled mode. The collection tube 36 has a proximate and distal end, in which the proximate end of the collection tube 36 is attached around the output vent collar 26, so that the collection tube 36 is in fluid communications with the hollow core 22 of the vent chamber 20. The housing 38 including a fore chamber 40; an aft chamber 42; an electric fan 44; a input sleeve 46; an output sleeve 48; an activation switch 50; an electrical cord 52; and a plug 54. The aft chamber 42 is in fluid communications with the fore chamber 40. The electric fan 44 is attached to the housing 38, in which the electric fan 44 defines the boundary between the fore and aft chamber (40 and 42, respectively) of the housing 38. The input sleeve 46 is attached to the fore chamber 40 of the housing 38, in which the input sleeve 46 defines an input orifice. The input sleeve 46 is attached to the distal end of the collection tube 36, in which the input orifice of the input sleeve 46 is in fluid communications with the hollow core 22 of the vent chamber 20. The input orifice of the input sleeve 46 is also in fluid communications with the fore chamber 40 of the housing 38. The output sleeve 48 is attached to the aft chamber 42 of the housing 38, in which the output sleeve 48 defines an output orifice, wherein the output orifice in fluid communications with the aft chamber 42. The activation switch 50 is attached to the housing 38, in which the activation switch 50 is operatively connected to the electrical fan 44 of the housing 38 and operatively connected to the on/off switch 30 of the vent chamber 20. The electrical cord 52 is attached to the housing 38, in which the electrical cord 52 is operatively connected to the activation switch 50. The plug 54 is attached to the electrical cord 52, in which the plug 54 is operatively connected to the electrical cord 52. The vent tube 56 has a distal and proximate end, in which the proximate end of the vent tube 56 is attached to the output sleeve 48, wherein the vent tube 56 is in fluid communications with the output orifice of the output sleeve 48 of the aft chamber 42 of the housing 38.

The filter 28 may be any known commercially available filtering apparatus. One preferred configuration of the filter 28 is that the filter 28 is detachably attachable to the input vent collar 24 of the vent chamber 20 of the device 10. Another preferred configuration of the filter 28 comprises activated charcoal. Yet another preferred configuration of the filter 28 comprises a High Efficiency Particle Air (HEPA) filter 28. Still another preferred configuration of the filter 28 comprises a porous paper filter 28.

The collection tube 36 may be any known commercially available conduit type material. One preferred configuration of the collection tube 36 is that it is flexible.

The vent tube 56 may be made of known commercially available conduit type material. One preferred configuration of the vent tube 56 is that it is flexible.

The base 18 of the device 10 may designed and shaped in any commercially known manner. One preferred configuration of the base 18 of the device 10 is that it has a height of at least one half inch so that any overflow water does not enter into the vent chamber sitting on top of the base 18.

An optional plurality of pressure switches 58 may be added to the device 10. The plurality of pressure switches 58 is mounted onto the movable toilet seat 14 of the commode 12, wherein the plurality of pressure switches 58 is operatively connected to the on/off switch 30.

An optional an adhesive pad 60 may be added to the device 10. The adhesive pad 60 is attached to the base 18 of the device 10 and attached to the top rear portion of the bowl 16 of the commode 12.

One preferred embodiment of a kit for assembling a toilet exhaust device 10 for placement onto a standard commode 12 having a movable toilet seat 14 pivotally hinged to a bowl 16 of the commode 12, the kit comprising: a base 18 mountable onto a top rear portion of the bowl 16 of the commode 12; a vent chamber 20 attached on top of the base 18 of the device 10, the vent chamber 20 including: a centrally disposed hollow core 22; an input vent collar 24 defining an input vent hole; an output vent collar 26 defining an output vent hole; a filter 28 attached around the input vent collar 24, the filter 28 in fluid communications between the air outside of the vent chamber 20 and in fluid communications with the centrally disposed hollow core 22 of the vent chamber 20; an on/off switch 30 attached to the vent chamber 20; a spring 32 attached to the on/off switch 30; a plunger 34 attached to the on/off switch 30 and attached to the spring 32, the plunger 34 is slidably connected to a back portion of the movable toilet seat 14, wherein when the movable toilet seat 14 is pivotally moved upwardly to a horizontal lowered position then the plunger 34 pushes into the on/off switch 30 whereby placing the on/off switch 30 in an enabled mode, when the movable toilet seat 14 is pivotally moved into a vertical upright position then the spring 32 pushes the plunger 34 away from the on/off switch 30 whereby retracting the plunger 34 from the on/off switch 30 thereby placing the on/off switch 30 in an unenabled mode; a collection tube 36 having a proximate and distal end, the proximate end of the collection tube 36 is attachable around the output vent collar 26, when the proximate end of the collection tube 36 then the collection tube 36 is in fluid communications with the hollow core 22 of the vent chamber 20; a housing 38, the housing 38 including: a fore chamber 40; an aft chamber 42, the aft chamber 42 is in fluid communications with the fore chamber 40; an electric fan 44 attached to the housing 38, the electric fan 44 defining the boundary between the fore and aft chamber (40 and 42, respectively) of the housing 38; a input sleeve 46 attached to the fore chamber 40 of the housing 38, the input sleeve 46 defining an input orifice, the input sleeve 46 is attachable to the distal end of the collection tube 36, when the input sleeve 46 is attached to the distal end of the collection tube 36 then the input orifice of the input sleeve 46 is in fluid communications with the hollow core 22 of the vent chamber 20, the input orifice of the input sleeve 46 is also in fluid communications with the fore chamber 40 of the housing 38; an output sleeve 48 attached to the aft chamber 42 of the housing 38, the output sleeve 48 defining an output orifice, the output orifice in fluid communications with the aft chamber 42; an activation switch 50 attached to the housing 38, the activation switch 50 is operatively connected to the electrical fan 44 of the housing 38 and operatively connected to the on/off switch 30 of the vent chamber 20; an electrical cord 52 attached to the housing 38, the electrical cord 52 is operatively connected to the activation switch 50; a plug 54 attached to the electrical cord 52, the plug 54 is operatively connected to the electrical cord 52; and a vent tube 56 having a distal and proximate end, the proximate end of the vent tube 56 is attachable to the output sleeve 48, when the proximate end of the vent tube 56 is attached to the output sleeve 48 then the vent tube 56 is in fluid communications with the output orifice of the output sleeve 48 of the aft chamber 42 of the housing 38.

An optional plurality of pressure switches 58 may be added to the kit. The plurality of pressure switches 58 are mountable onto the movable toilet seat 14 of the commode 12, so that when the plurality of pressure switches 58 are mounted onto the movable toilet seat 14 then the plurality of pressure switches 58 are operatively connected to the on/off switch 30.

An optional adhesive pad 60 may be added to the kit. The adhesive pad 60 is attachable onto the base 18 of the device 10 and attachable to the top rear portion of the bowl 16 of the commode 12.

One preferred embodiment of the method of using a kit for assembling a toilet exhaust device 10 for placement onto a standard commode 12 having a movable toilet seat 14 pivotally hinged to a bowl 16 of the commode 12, the method comprising the steps of adhering, adjoining, affixing, coupling, defecating, drilling, dropping, flushing, inserting, leaving, lifting, obtaining, plugging, pressing, sitting, standing, and sticking. The obtaining step comprises obtaining the kit comprising: a base 18 mountable onto a top rear portion of the bowl 16 of the commode 12; a vent chamber 20 attached on top of the base 18 of the device 10, the vent chamber 20 including: a centrally disposed hollow core 22; an input vent collar 24 defining an input vent hole; an output vent collar 26 defining an output vent hole; a filter 28 attached around the input vent collar 24, the filter 28 in fluid communications between the air outside of the vent chamber 20 and in fluid communications with the centrally disposed hollow core 22 of the vent chamber 20; an on/off switch 30 attached to the vent chamber 20; a spring 32 attached to the on/off switch 30; and a plunger 34 attached to the on/off switch 30 and attached to the spring 32, the plunger 34 is slidably connected to a back portion of the movable toilet seat 14, wherein when the movable toilet seat 14 is pivotally moved upwardly to a horizontal lowered position then the plunger 34 pushes into the on/off switch 30 whereby placing the on/off switch 30 in an enabled mode, when the movable toilet seat 14 is pivotally moved into a vertical upright position then the spring 32 pushes the plunger 34 away from the on/off switch 30 whereby retracting the plunger 34 from the on/off switch 30 thereby placing the on/off switch 30 in an unenabled mode; a collection tube 36 having a proximate and distal end, the proximate end of the collection tube 36 is attachable around the output vent collar 26, when the proximate end of the collection tube 36 then the collection tube 36 is in fluid communications with the hollow core 22 of the vent chamber 20; a housing 38, the housing 38 including: a fore chamber 40, an aft chamber 42, the aft chamber 42 is in fluid communications with the fore chamber 40; an electric fan 44 attached to the housing 38, the electric fan 44 defining the boundary between the fore and aft chamber (40 and 42, respectively) of the housing 38; a input sleeve 46 attached to the fore chamber 40 of the housing 38, the input sleeve 46 defining an input orifice, the input sleeve 46 is attachable to the distal end of the collection tube 36, when the input sleeve 46 is attached to the distal end of the collection tube 36 then the input orifice of the input sleeve 46 is in fluid communications with the hollow core 22 of the vent chamber 20, the input orifice of the input sleeve 46 is also in fluid communications with the fore chamber 40 of the housing 38; an output sleeve 48 attached to the aft chamber 42 of the housing 38, the output sleeve 48 defining an output orifice, the output orifice in fluid communications with the aft chamber 42; an activation switch 50 attached to the housing 38, the activation switch 50 is operatively connected to the electrical fan 44 of the housing 38 and operatively connected to the on/off switch 30 of the vent chamber 20; an electrical cord 52 attached to the housing 38, the electrical cord 52 is operatively connected to the activation switch 50; and a plug 54 attached to the electrical cord 52, the plug 54 is operatively connected to the electrical cord 52; a vent tube 56 having a distal and proximate end, the proximate end of the vent tube 56 is attachable to the output sleeve 48, when the proximate end of the vent tube 56 is attached to the output sleeve 48 then the vent tube 56 is in fluid communications with the output orifice of the output sleeve 48 of the aft chamber 42 of the housing 38; and an adhesive pad 60 attachable onto the base 18 of the device 10 and attachable to the top rear portion of the bowl 16 of the commode 12. The sticking step comprises sticking one side of the adhesive pad 60 onto the top rear portion of the bowl 16 of the commode 12. The adhering step comprises adhering the other side of the adhesive pad 60 onto the base 18. The affixing step comprises affixing the proximate end of the collection tube 36 is around the output vent collar 26 so that the collection tube 36 is in fluid communications with the hollow core 22 of the vent chamber 20. The coupling step comprises coupling the distal end of the collection tube 36 to the input sleeve 46 of the housing 38 so that the input orifice of the input sleeve 46 is in fluid communications with the hollow core 22 of the vent chamber 20, and so that the input orifice of the input sleeve 46 is also in fluid communications with the fore chamber 40 of the housing 38. The drilling step comprises drilling a hole through a wall near the commode 12. The inserting step comprises inserting the distal end of the vent tube 56 through the hole in the wall. The adjoining step comprises adjoining the proximate end of the vent tube 56 to the output sleeve 48 of the housing 38 so that the vent tube 56 is in fluid communications with the output orifice of the output sleeve 48 of the aft chamber 42 of the housing 38. The plugging step comprises plugging in the plug 54 attached to the electrical cord 52 in to an electrical outlet socket. The pressing step comprises pressing on the activation switch 50 attached to the housing 38. The dropping step comprises dropping pivotally downwardly the movable toilet seat 14 to the horizontal lowered position so that the plunger 34 pushes into the on/off switch 30 whereby placing the on/off switch 30 in an enabled mode and enabling the fan 44 to exhaust. The sitting step comprises sitting onto the movable toilet set to the horizontal lowered position. The defecating step comprises defecating into the bowl 16 of the commode 12 while sitting to produce a foul smelling feces. The standing step comprises standing up after the defecating step. The flushing step comprises flushing the commode 12 to remove the foul smelling feces, the flushing step performed after the defecating step. The leaving step comprises leaving the movable toilet seat 14 in the horizontally lowered position to further allow the fan 44 to exhaust the leaving step performed after the defecating step. The lifting step comprises lifting pivotally upwardly the movable toilet seat 14 into the vertical upright position so that the spring 32 pushes the plunger 34 away from the on/off switch 30 whereby retracting the plunger 34 from the on/off switch 30 thereby placing the on/off switch 30 in an unenabled mode and stopping the fan 44 from exhausting, the lifting step performed subsequent to the leaving step.

Referring now to FIG. 1 which depicts a perspective view of a preferred embodiment of the toilet exhaust device 10 showing a standard commode 12 having a movable toilet seat 14 pivotally hinged to a bowl 16 of the commode 12. The device 10 is shown having: a base 18; a vent chamber 20; a collection tube 36; a housing 38; and a vent tube 56. The base 18 is mounted onto a top rear portion of the bowl 16 of the commode 12. The vent chamber 20 is shown attached on top of the base 18 of the device 10, in which the vent chamber 20 includes: a filter 28; and a plunger 34. The filter 28 is shown attached around the input vent collar 24, in which the filter 28 is in fluid communications between the air outside of the vent chamber 20 and in fluid communications with the centrally disposed hollow core 22 of the vent chamber 20. The plunger 34 is shown slidably connected to a back portion of the movable toilet seat 14, wherein when the movable toilet seat 14 is pivotally moved upwardly to a horizontal lowered position then the plunger 34 pushes into the on/off switch 30 whereby placing the on/off switch 30 in an enabled mode, wherein when the movable toilet seat 14 is pivotally moved into a vertical upright position then the spring 32 pushes the plunger 34 away from the on/off switch 30 whereby retracting the plunger 34 from the on/off switch 30 thereby placing the on/off switch 30 in an unenabled mode. The collection tube 36 is shown having a proximate and distal end, in which the proximate end of the collection tube 36 is shown attached around the output vent collar 26, so that the collection tube 36 is in fluid communications with the hollow core 22 of the vent chamber 20. The housing 38 is shown including an activation switch 50; an electrical cord 52; and a plug 54. The activation switch 50 is shown attached to the housing 38, in which the activation switch 50 is operatively connected to the electrical fan 44 of the housing 38 and operatively connected to the on/off switch 30 of the vent chamber 20. The electrical cord 52 is shown attached to the housing 38, in which the electrical cord 52 is operatively connected to the activation switch 50. The plug 54 is shown attached to the electrical cord 52, in which the plug 54 is operatively connected to the electrical cord 52. The vent tube 56 is shown having a distal and proximate end, in which the proximate end of the vent tube 56 is attached to the output sleeve 48, wherein the vent tube 56 is in fluid communications with the output orifice of the output sleeve 48 of the aft chamber 42 of the housing 38.

Referring now to FIG. 2 which depicts a partial cross sectional side view of a preferred embodiment of the toilet exhaust device 10 showing a standard commode 12 having a movable toilet seat 14 pivotally hinged to a bowl 16 of the commode 12. The device 10 is shown having a base 18; a vent chamber 20; and an adhesive pad 60. The base 18 is shown mounted onto a top rear portion of the bowl 16 of the commode 12 via the adhesive pad 60. The vent chamber 20 is shown attached on top of the base 18 of the device 10, in which the vent chamber 20 includes: a centrally disposed hollow core 22; an input vent collar 24; an output vent collar 26; a filter 28; an on/off switch 30; a spring 32; and a plunger 34. The input vent collar 24 is shown defining an input vent hole. The output vent collar 26 is shown defining an output vent hole. The filter 28 is shown attached around the input vent collar 24, in which the filter 28 is in fluid communications between the air outside of the vent chamber 20 and in fluid communications with the centrally disposed hollow core 22 of the vent chamber 20. The on/off switch 30 is shown attached to the vent chamber 20. The spring 32 is attached to the on/off switch 30. The plunger 34 is shown attached to both the on/off switch 30 and attached to the spring 32. The plunger 34 is shown slidably connected to a back portion of the movable toilet seat 14.

Referring now to FIG. 3 which depicts a cross sectional view of the housing of a preferred embodiment of the toilet exhaust device 10 showing the housing 38 is shown having a fore chamber 40; an aft chamber 42; an electric fan 44; a input sleeve 46; an output sleeve 48; an activation switch 50; and an electrical cord 52. The aft chamber 42 is shown in fluid communications with the fore chamber 40. The electric fan 44 is shown attached to the housing 38, in which the electric fan 44 is shown defining the boundary between the fore and aft chamber (40 and 42, respectively) of the housing 38. The input sleeve 46 is shown attached to the fore chamber 40 of the housing 38, in which the input sleeve 46 is shown defining an input orifice. The input sleeve 46 is shown attached to the distal end of the collection tube 36, in which the input orifice of the input sleeve 46 is in fluid communications with the hollow core 22 of the vent chamber 20. The input orifice of the input sleeve 46 is also in fluid communications with the fore chamber 40 of the housing 38. The output sleeve 48 is shown attached to the aft chamber 42 of the housing 38, in which the output sleeve 48 is shown defining an output orifice, wherein the output orifice in fluid communications with the aft chamber 42. The activation switch 50 is shown attached to the housing 38, in which the activation switch 50 is operatively connected to the electrical fan 44 of the housing 38 and operatively connected to the on/off switch 30 of the vent chamber 20. The electrical cord 52 is shown attached to the housing 38, in which the electrical cord 52 is operatively connected to the activation switch 50. The vent tube 56 is shown having a distal and proximate end, in which the proximate end of the vent tube 56 is shown attached to the output sleeve 48, wherein the vent tube 56 is in fluid communications with the output orifice of the output sleeve 48 of the aft chamber 42 of the housing 38.

Figure 4:
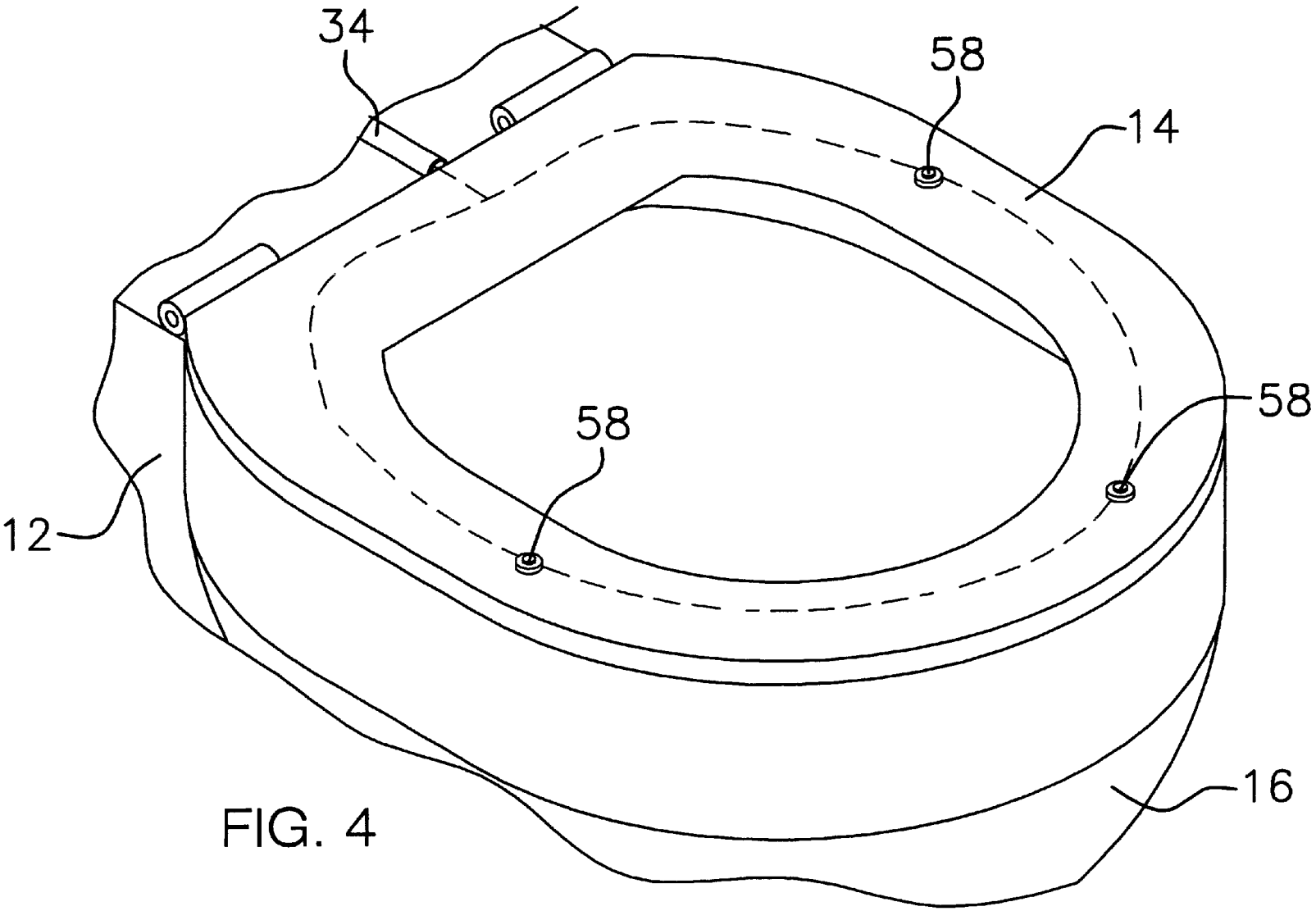
FIG. 4 is a perspective view of the optional plurality of pressure switches of a preferred embodiment of the toilet exhaust device of the present invention.

Referring now to FIG. 4 which depicts a perspective view of the optional plurality of pressure switches 60 of a preferred embodiment of the toilet exhaust device 10 attached on a standard commode 12 having a movable toilet seat 14 pivotally hinged to a bowl 16 of the commode 12. The device 10 is also shown having a plunger 34 slidably connected to a back portion of the movable toilet seat 14.

As to the manner of usage and operation of the present invention, the same should be apparent from the above description. Accordingly, no further discussion relating to the manner of usage and operation will be provided.

While a preferred embodiment of the toilet exhaust device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

With respect to the above description then, it is to be realized that the optimum dimensional relationships for the parts of the invention, to include variations in size materials, shape, form, function and manner of operation, assembly and use, are deemed readily apparent and obvious to one skilled in the art, and all equivalent relationships to those illustrated in the drawings and described in the specification are intended to be encompassed by the present invention.

Throughout this specification, unless the context requires otherwise, the word "comprise" or variations such as "comprises" or comprising" or the term "includes or variations, thereof, or the them "having" or variations, thereof will be understood to imply the inclusion of a stated element or integer or group of elements or integers but not the exclusion of any other element or integer or group of elements or integers. In this regard, in construing the claim scope, an embodiment where one or more features is added to any of the claims is to be regarded as within the scope of the invention given that the essential features of the invention as claimed are included in such an embodiment.

Those skilled in the art will appreciate that the invention described herein is susceptible to variations and modifications other than those specifically described. It is to be understood that the invention includes all such variations and modifications that fall within its spirit and scope. The invention also includes all of the steps, features, compositions and compounds referred to or indicated in this specification, individually or collectively, and any and all combination any two or more of said steps or features.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toilet exhaust device for placement onto a standard commode having a movable toilet seat pivotally hinged to a bowl of the commode, said device comprising:

a base mounted onto a top rear portion of the bowl of the commode;

a vent chamber attached on top of said base of said device, said vent chamber including:

a centrally disposed hollow core;

an input vent collar defining an input vent hole;

an output vent collar defining an output vent hole;

a filter attached around said input vent collar, said filter in fluid communications between the air outside of said vent chamber and in fluid communications with said centrally disposed hollow core of said vent chamber;

an on/off switch attached to said vent chamber;

a spring attached to said on/off switch; and a plunger attached to said on/off switch and attached to said spring, said plunger is slidably connected to a back portion of the movable toilet seat, wherein when the movable toilet seat is pivotally moved upwardly to a horizontal lowered position then said plunger pushes into said on/off switch whereby placing said on/off switch in an enabled mode, when the movable toilet seat is pivotally moved into a vertical upright position then said spring pushes said plunger away from said on/off switch whereby retracting said plunger from said on/off switch thereby placing said on/off switch in an unenabled mode;

a collection tube having a proximate and distal end, said proximate end of said collection tube is attached around said output vent collar, said collection tube is in fluid communications with said hollow core of said vent chamber;

a housing, said housing including:

a fore chamber;

an aft chamber, said aft chamber is in fluid communications with said fore chamber;

an electric fan attached to said housing, said electric fan defining the boundary between said fore and aft chambers of said housing;

a input sleeve attached to said fore chamber of said housing, said input sleeve defining an input orifice, said input sleeve attached to said distal end of said collection tube, said input orifice of said input sleeve is in fluid communications with said hollow core of said vent chamber, said input orifice of said input sleeve is also in fluid communications with said fore chamber of said housing;

an output sleeve attached to said aft chamber of said housing, said output sleeve defining an output orifice, said output orifice in fluid communications with said aft chamber;

an activation switch attached to said housing, said activation switch is operatively connected to said electrical fan of said housing and operatively connected to said on/off switch of said vent chamber;

an electrical cord attached to said housing, said electrical cord is operatively connected to said activation switch; and a plug attached to said electrical cord, said plug is operatively connected to said electrical cord; and a vent tube having a distal and proximate end, said proximate end of said vent tube attached to said output sleeve, said vent tube in fluid communications with said output orifice of said output sleeve of said aft chamber of said housing.

2. The device of claim 1 further comprising a plurality of pressure switches mounted onto the movable toilet seat of the commode, said plurality of pressure switches are operatively connected to said on/off switch.

3. The device of claim 1 further comprising an adhesive pad attached to said base of said device and attached to the top rear portion of the bowl of the commode.

4. The device of claim 1 wherein said filter is detachably attachable to said input vent collar of said vent chamber of said device.

5. The device of claim 1 wherein said filter comprises activated charcoal.

6. The device of claim 1 wherein said filter comprises a High Efficiency Particle Air (HEPA) filter.

7. The device of claim 1 wherein said filter comprises a porous paper filter.

8. The device of claim 1 wherein said collection tube is flexible.

9. The device of claim 1 wherein said vent tube is flexible.

10. The device of claim 1 wherein said base of said device has a height of at least one half inch.

11. A kit for assembling a toilet exhaust device for placement onto a standard commode having a movable toilet seat pivotally hinged to a bowl of the commode, said kit comprising:

a base mountable onto a top rear portion of the bowl of the commode;

a vent chamber attached on top of said base of said device, said vent chamber including:

a centrally disposed hollow core;

an input vent collar defining an input vent hole;

an output vent collar defining an output vent hole;

a filter attached around said input vent collar, said filter in fluid communications between the air outside of said vent chamber and in fluid communications with said centrally disposed hollow core of said vent chamber;

an on/off switch attached to said vent chamber;

a spring attached to said on/off switch; and a plunger attached to said on/off switch and attached to said spring, said plunger is slidably connected to a back portion of the movable toilet seat, wherein when the movable toilet seat is pivotally moved upwardly to a horizontal lowered position then said plunger pushes into said on/off switch whereby placing said on/off switch in an enabled mode, when the movable toilet seat is pivotally moved into a vertical upright position then said spring pushes said plunger away from said on/off switch whereby retracting said plunger from said on/off switch thereby placing said on/off switch in an unenabled mode;

a collection tube having a proximate and distal end, said proximate end of said collection tube is attachable around said output vent collar, when said proximate end of said collection tube then said collection tube is in fluid communications with said hollow core of said vent chamber;

a housing, said housing including:

a fore chamber;

an aft chamber, said aft chamber is in fluid communications with said fore chamber;

an electric fan attached to said housing, said electric fan defining the boundary between said fore and aft chambers of said housing;

a input sleeve attached to said fore chamber of said housing, said input sleeve defining an input orifice, said input sleeve is attachable to said distal end of said collection tube, when said input sleeve is attached to said distal end of said collection tube then said input orifice of said input sleeve is in fluid communications with said hollow core of said vent chamber, said input orifice of said input sleeve is also in fluid communications with said fore chamber of said housing;

an output sleeve attached to said aft chamber of said housing, said output sleeve defining an output orifice, said output orifice in fluid communications with said aft chamber;

an activation switch attached to said housing, said activation switch is operatively connected to said electrical fan of said housing and operatively connected to said on/off switch of said vent chamber;

an electrical cord attached to said housing, said electrical cord is operatively connected to said activation switch; and a plug attached to said electrical cord, said plug is operatively connected to said electrical cord; and a vent tube having a distal and proximate end, said proximate end of said vent tube is attachable to said output sleeve, when said proximate end of said vent tube is attached to said output sleeve then said vent tube is in fluid communications with said output orifice of said output sleeve of said aft chamber of said housing.

12. The kit of claim 11 further comprising a plurality of pressure switches mountable onto the movable toilet seat of the commode, wherein when said plurality of pressure switches are mounted on the movable toilet seat of the commode then the plurality of pressure switches is operatively connected to said on/off switch.

13. The kit of claim 11 further comprising an adhesive pad attachable onto said base of said device and attachable to the top rear portion of the bowl of the commode.

14. The kit of claim 11 wherein said filter is detachably attachable to said input vent collar of said vent chamber of said device.

15. The kit of claim 11 wherein said filter comprises activated charcoal.

16. The kit of claim 11 wherein said filter comprises a High Efficiency Particle Air (HEPA) filter.

17. The kit of claim 11 wherein said filter comprises a porous paper filter.

18. The kit of claim 11 wherein said collection tube is flexible.

19. The kit of claim 11 wherein said vent tube is flexible.

20. Method of using a kit for assembling a toilet exhaust device for placement onto a standard commode having a movable toilet seat pivotally hinged to a bowl of the commode, the method comprising:

obtaining the kit comprising:

a base mountable onto a top rear portion of the bowl of the commode;

a vent chamber attached on top of the base of the device, the vent chamber including:

a centrally disposed hollow core;

an input vent collar defining an input vent hole;

an output vent collar defining an output vent hole;

a filter attached around the input vent collar, the filter in fluid communications between the air outside of the vent chamber and in fluid communications with the centrally disposed hollow core of the vent chamber;

an on/off switch attached to the vent chamber;

a spring attached to the on/off switch; and a plunger attached to the on/off switch and attached to the spring, the plunger is slidably connected to a back portion of the movable toilet seat, wherein when the movable toilet seat is pivotally moved upwardly to a horizontal lowered position then the plunger pushes into the on/off switch whereby placing the on/off switch in an enabled mode, when the movable toilet seat is pivotally moved into a vertical upright position then the spring pushes the plunger away from the on/off switch whereby retracting the plunger from the on/off switch thereby placing the on/off switch in an unenabled mode;

a collection tube having a proximate and distal end, the proximate end of the collection tube is attachable around the output vent collar, when the proximate end of the collection tube then the collection tube is in fluid communications with the hollow core of the vent chamber;

a housing, the housing including:

a fore chamber;

an aft chamber, the aft chamber is in fluid communications with the fore chamber;

an electric fan attached to the housing, the electric fan defining the boundary between the fore and aft chambers of the housing;

a input sleeve attached to the fore chamber of the housing, the input sleeve defining an input orifice, the input sleeve is attachable to the distal end of the collection tube, when the input sleeve is attached to the distal end of the collection tube then the input orifice of the input sleeve is in fluid communications with the hollow core of the vent chamber, the input orifice of the input sleeve is also in fluid communications with the fore chamber of the housing;

an output sleeve attached to the aft chamber of the housing, the output sleeve defining an output orifice, the output orifice in fluid communications with the aft chamber;

an activation switch attached to the housing, the activation switch is operatively connected to the electrical fan of the housing and operatively connected to the on/off switch of the vent chamber;

an electrical cord attached to the housing, the electrical cord is operatively connected to the activation switch; and a plug attached to the electrical cord, the plug is operatively connected to the electrical cord;

a vent tube having a distal and proximate end, the proximate end of the vent tube is attachable to the output sleeve, when the proximate end of the vent tube is attached to the output sleeve then the vent tube is in fluid communications with the output orifice of the output sleeve of the aft chamber of the housing; and an adhesive pad attachable onto the base of the device and attachable to the top rear portion of the bowl of the commode;

sticking one side of the adhesive pad onto the top rear portion of the bowl of the commode;

adhering the other side of the adhesive pad onto the base;

affixing the proximate end of the collection tube is around the output vent collar so that the collection tube is in fluid communications with said hollow core of said vent chamber;

coupling the distal end of the collection tube to the input sleeve of the housing so that the input orifice of the input sleeve is in fluid communications with the hollow core of the vent chamber, and so that the input orifice of the input sleeve is also in fluid communications with the fore chamber of the housing;

drilling a hole through a wall near the commode;

inserting the distal end of the vent tube through the hole in the wall;

adjoining the proximate end of the vent tube to the output sleeve of the housing so that the vent tube is in fluid communications with the output orifice of the output sleeve of the aft chamber of the housing;

plugging in the plug attached to the electrical cord in to an electrical outlet socket;

pressing on the activation switch attached to the housing;

dropping pivotally downwardly the movable toilet seat to the horizontal lowered position so that the plunger pushes into the on/off switch whereby placing the on/off switch in an enabled mode and enabling the fan to exhaust;

sitting onto the movable toilet set to the horizontal lowered position;

defecating into the bowl of the commode while sitting to produce a foul smelling feces;

standing up after said defecating step;

flushing the commode to remove the foul smelling feces, said flushing step performed after said defecating step;

leaving the movable toilet seat in the horizontally lowered position to further allow the fan to exhaust, said leaving step performed after said defecating step; and lifting pivotally upwardly the movable toilet seat into the vertical upright position so that the spring pushes the plunger away from the on/off switch whereby retracting the plunger from the on/off switch thereby placing the on/off switch in an unenabled mode and stopping the fan from exhausting, said lifting step performed subsequent to said leaving step.

* * * * *